United States Patent [19]

Ou

[11] 4,255,939

[45] Mar. 17, 1981

[54] FOUR WAY REVERSING VALVE

[75] Inventor: Sam A. Ou, St. Louis, Mo.

[73] Assignee: Emerson Electric Co., St. Louis, Mo.

[21] Appl. No.: 41,014

[22] Filed: May 21, 1979

[51] Int. Cl.[3] ..... F25B 13/00

[52] U.S. Cl. ..... 62/324 A; 137/625.29; 62/160

[58] Field of Search ..... 62/160, 324 A, 324 R; 137/599.1, 625.29, 625.43; 251/129, 11, 138, 263

[56] References Cited

U.S. PATENT DOCUMENTS

| | | | |
|---|---|---|---|
| 2,974,682 | 3/1961 | Trask | 62/324 A |
| 2,976,701 | 3/1961 | Greenawalt | 62/324 A |
| 3,056,574 | 10/1962 | Greenawalt | 137/625.29 |
| 3,303,665 | 2/1967 | Ray | 62/324 A |
| 3,400,736 | 9/1968 | Bastle et al. | 62/324 A |
| 3,448,959 | 6/1969 | McHale et al. | 137/625.29 |
| 3,894,561 | 7/1975 | Thornberg | 137/625.29 |
| 4,112,974 | 9/1978 | Davis | 62/324 A |

*Primary Examiner*—Lloyd L. King

*Attorney, Agent, or Firm*—Polster, Polster and Lucchesi

[57] ABSTRACT

A four way reversing valve utilized in the refrigerant flow system of a heat pump or the like for selectively directing the flow of high pressure refrigerant either to the inside or outside heat exchange coil of the heat pump thereby to selectively either effect heating or cooling of the space in which the inside coil is located. The valve has an improved slide valve design which significantly lessens flow losses through the valve.

13 Claims, 9 Drawing Figures

FIG. 1.
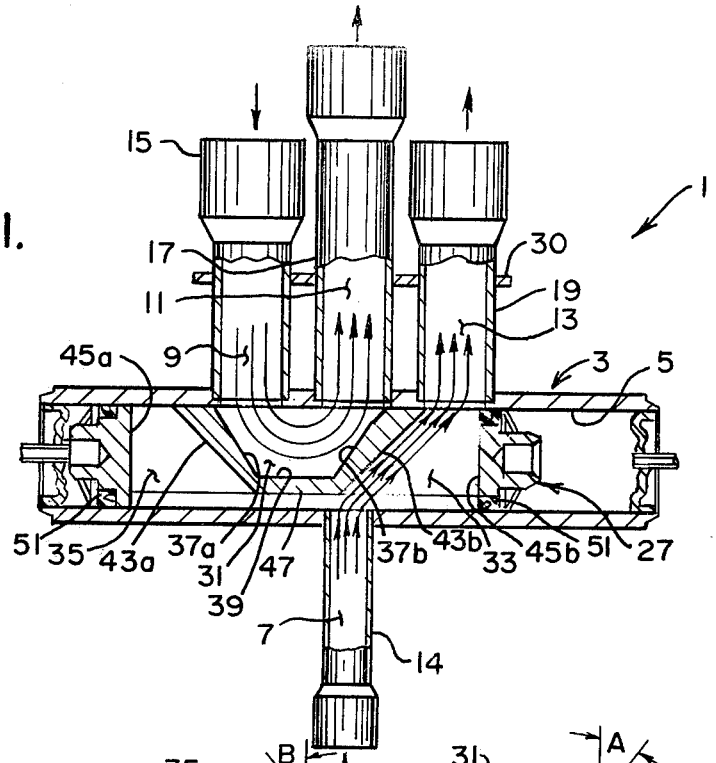
FIG. 2.
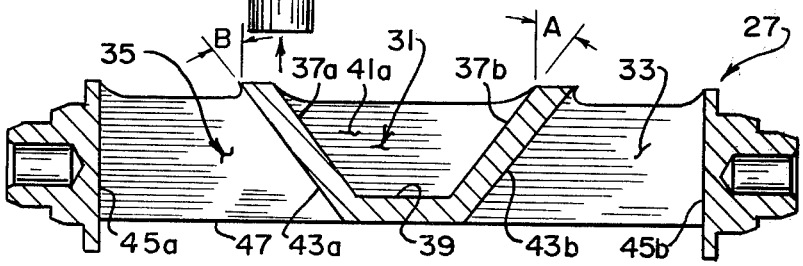
FIG. 3.
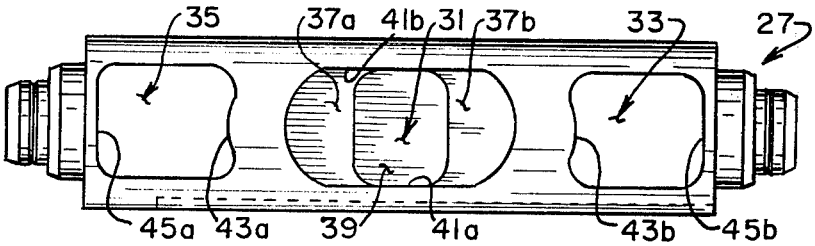
FIG. 4.
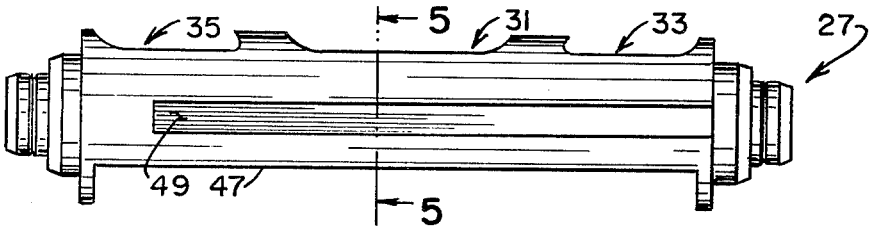
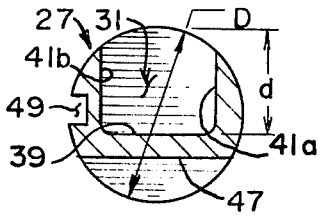
FIG. 5.

FIG. 6.
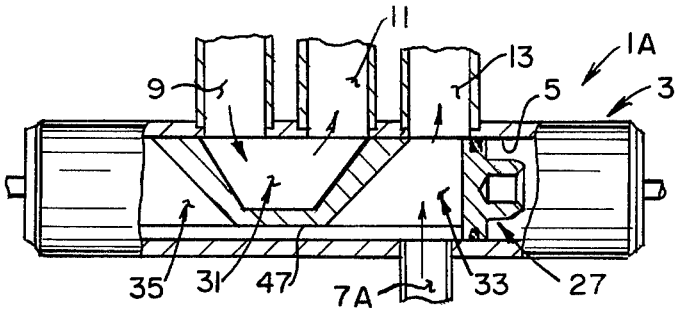
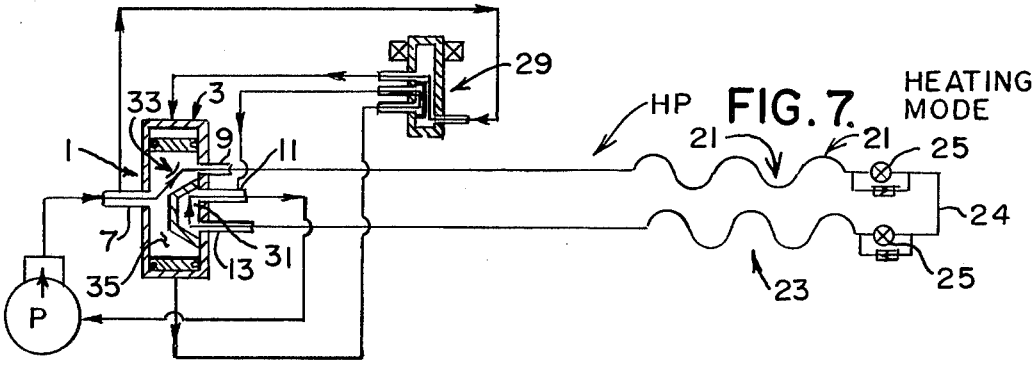
FIG. 7.
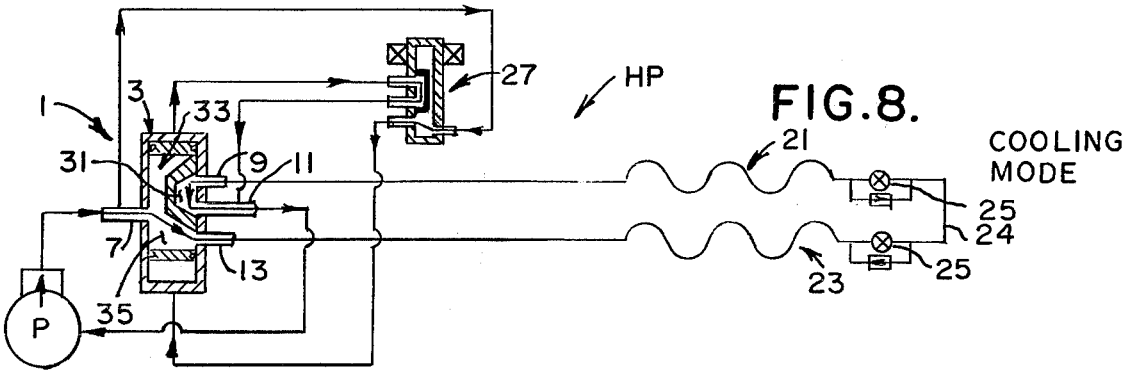
FIG. 8.
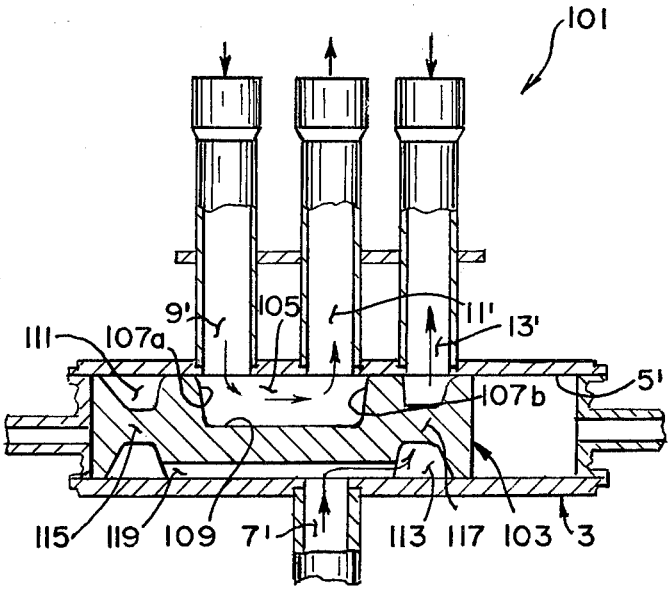
FIG. 9.
PRIOR ART

FOUR WAY REVERSING VALVE

BACKGROUND OF THE INVENTION

This invention relates to a so-called four way reversing valve finding particular use, for example, in a heat pump for selectively switching operation of the heat pump between its heating and cooling modes of operation. More specifically, this invention relates to an improved four way reversing valve having improved refrigerant flow characteristics and further having significantly less flow losses (i.e., pressure drop) than prior art reversing valves.

More generally, a heat pump system is a refrigeration system which in essence includes a compressor, a first air-to-air heat exchange coil located within the space (e.g., a home) to be heated or cooled and a second air-to-air heat exchange coil located outside the space (e.g., out-of-doors). A reversing valve is interposed in the refrigerant lines connecting the coils to the compressor for directing the flow of high pressure refrigerant to either the inside or outside coil so as to either heat or cool the space. When operated for in its cooling mode, the heat pump functions as an air conditioner, and when operated in its heating mode, the heat pump efficiently and economically elevates the potential of low grade heat in the outside air (or other heat source) to a level useful in heating the inside space.

In the typical air-to-air heat pump, both refrigerant heat exchangers (i.e., the inside and outside coils) are sized and designed to serve either as an evaporator or a condenser according to the operational mode chosen for the heat pump. Typically, a four way reversing valve is utilized to select the operational mode of the heat pump. These valves include four refrigerant connections, viz, a so-called discharge port intended to be connected to the discharge or high pressure side of the compressor, a suction port adapted to be connected to the suction or inlet side of the compresser, and a pair of combined inlet/outlet ports each of which is intended to be connected to a respective coil. Of course, the coils are interconnected so that refrigerant flows from one to another and appropriate expansion valves are provided.

Prior art reversing valves typically include a valve body in which the four above-noted ports or connections are provided. A slide member having a number of flow passages therein is provided in an axial bore of the valve body and is slidably movable in the body under the control of a solenoid actuated pilot valve so as to direct the discharge of the compressor either to the inside coil or the outside coil and to simultaneously direct the low pressure refrigerant from either the outside or inside coil to the suction side of the compressor so that the system may either be operated in its heating or cooling mode.

Reference may be made to such prior U.S. Pat. Nos. as 2,933,107, 3,004,557 and 3,037,525 which are co-assigned to the assignee of the present invention and which disclose several prior art four-way change over or reversing valves utilized in heat pump systems. While these and other prior art valves have operated well for their intended purposes, they are known to cause a significant pressure drop in the refrigerant flowing therethrough which, of course, lowers the overall efficiency of the entire heat pump system. In order to hold the pressure drop at a manageable limit, prior art reversing valves are typically of a relatively large size and weight.

Among the several objects and features of the present invention may be noted the provision of a reversing valve which in principle and operation is similar to prior art reversing valves and yet which suprisingly exerts significantly less restriction to the flow of refrigerant therethrough at both the suction and discharge sides of the valve;

The provision of such a valve which may be significantly smaller and of lighter weight (and hence less costly) than comparable prior art valves and yet which is capable of handling comparable flow rates of refrigerant therethrough with comparable flow losses and pressure drops; and, in general;

The provision of such a valve which is of simple and rugged construction, which is easy and economical to manufacture, and which is reliable in operation.

Other objects and features of this invention will be in part apparent and in part pointed out hereinafter.

SUMMARY OF THE INVENTION

Briefly, a reversing valve of the present invention is intended to be utilized with a heat pump system or the like, the latter including a first coil, a second coil, with the first and second coils being operatively connected to one another, and a compressor having a suction inlet for drawing low pressure refrigerant from one of the coils and a discharge outlet for supplying the refrigerant at high pressure to the other of the coils. The reversing valve is adapted to be connected in a heat pump system and is selectively operable in either a first operative position for supplying high pressure refrigerant to the first coil and for receiving low pressure refrigerant from the second coil or a second operative position for supplying high pressure refrigerant to the second coil and for receiving low pressure refrigerant from the first coil. The valve has a body with a bore therein, and further has a plurality of ports through the body in communication with the bore. These ports include a high pressure inlet port adapted to be connected to the discharge outlet of the compressor, a low pressure outlet port adapted to be connected to the suction inlet of the compressor, a first inlet/outlet port adapted to be connected to the first coil, and a second inlet/outlet port adapted to be connected to the second coil. The valve further includes a slide sealably, slidably movable in axial direction within the bore between a first position in which the reversing valve is in its first operative position and a second position in which the reversing valve is in its second operative position. The slide has a flow switching cavity therein in communication with the low pressure outlet port and with the second inlet/outlet port when the slide is in its first position and in communication with the low pressure outlet port and with the first inlet/outlet port when the slide is in its second position for receiving low pressure refrigerant from one of the coils and for directing it to the suction side of the compressor. A first flow passage is provided through the slide for communication between the high pressure inlet port and the first inlet/outlet port when the slide is in its first position and a second flow passage is also provided for communication between the high pressure inlet port and the second inlet/outlet port when the slide is in its second position. The slide further has a pair of inclined surfaces forming the ends of the cavity and another surface forming the bottom of the cavity. These inclined surfaces angle inwardly toward one another and toward the bottom of the cavity with their outer ends of the inclined surfaces defining a cavity mouth of such size that the low pressure outlet ports and one of the inlet/outlet ports are in register with the cavity when the slide is in either its first or second position whereby the fluid flowing through the cavity is smoothly deflected by the inclined surfaces so as to enter the low pressure outlet port with a minimum loss of momentum or flow energy.

BRIEF DESCRIPTION OF THE DRAWINGS

FIG. 1 is a partial longitudinal cross section view of a four way reversing valve of the present invention in one of its operative positions;

FIG. 2 is an enlarged longitudinal cross sectional view of an improved slide member of the present invention;

FIG. 3 is a plan view of the slide member;

FIG. 4 is a side elevational view of the slide member;

FIG. 5 is a vertical cross sectional view taken along line 5—5 of FIG. 4 illustrating the slide member and a flow reversing cavity therein in cross section;

FIG. 6 is a view similar to FIG. 1 of a second embodiment of the reversing valve of the present invention with parts partially broken away for clarity;

FIG. 7 is a diagrammatic view of a heat pump system incorporating an improved reversing valve of the present invention with the heat pump system being operated in its heating mode of operation;

FIG. 8 is a view similar to FIG. 7 with the heat pump system being operated in its cooling mode of operation; and FIG. 9 is a longitudinal cross sectional view of a prior art four way reversing valve.

Corresponding reference characters indicate corresponding parts throughout the several views of the drawings.

DESCRIPTION OF PREFERRED EMBODIMENTS

Referring now to the drawings and more particularly to FIGS. 1–5, a first embodiment of a four way reversing valve of the present invention is indicated in its entirety by reference character 1. Valve 1 is shown to comprise an elongate tubular body 3 having a longitudinal bore 5 extending axially therewithin. A plurality (e.g., four) of ports are provided in body 3. More specifically, an inlet port 7 (also referred to as a discharge port) is provided, this inlet port being adapted to be connected in a heat pump system HP (as shown in FIGS. 7 and 8) to the discharge side (e.g., to the high pressure outlet side) of a compressor P of the heat pump system. Thus, a refrigerant fluid, such as R-22 refrigerant which is generically known as monochlrodiflurometh-ane, is admitted into bore 5 port 7 under high pressure from the discharge side of the compressor. This valve further includes a first inlet/outlet port 9, a low pressure outlet port 11 (also known as a suction port), and a second inlet/outlet port 13. Each of these ports 7, 9, 11 and 13 is provided with a respective fitting or coupling 14, 15, 17, or 19 so as to permit it to be sealably connected in the refrigerant piping system of the heat pump HP.

As shown in FIGS. 7 and 8, inlet/outlet port 9 is connected to a first air-to-air heat exchange coil 21 and inlet/outlet port 11 is connected to a second air-to-air heat exchange coil 23. These coils are operatively connected to one another by means of a refrigerant line 24. Suitable expansion valves 25 are provided for expansion of the refrigerant. First coil 21 is located inside the space (e.g., inside a home) to be heated or cooled by heat pump system HP and the other coil is located outside the space (e.g., located out-of-doors) and thus coils 21 and 23 are herein referred to respectively as inside and outside coils. It will, however, be appreciated that in other applications, the second coil need not be located out-of-doors. Inside and outside coils 21 and 23 are each so sized and configured as to operate either as an evaporator coil or as a condenser coil in the heat pump system, depending on whether the heating or cooling mode of operation of the heat pump system is selected.

As is known, valve 1 has means for reversing the direction of flow of refrigerant to coils 21 and 23 so that the heat pump system may be selectively operated either to cool or to het the home. The reversal of the heat pump system is accomplished by axially shifting a slide valve member 27 which is slidably, sealably received in bore 5 of body 3 between a first position in which high pressure refrigerant is directed to inside coil 21 and in which the inside coil acts as a condenser so as to give off heat to heat the house (see FIG. 7) and the outside coil acts as an evaporator, and a second position (as shown in FIGS. 1 and 8) in which the high pressure refrigerant is first directed to outside coil 23 so that it acts as a condenser and the inside coil 21 acts as an evaporator thereby to absorb heat from within the house and to cool the house. Valve 1 is typically selectively shifted between its first and second positions by means of a solenoid operated pilot valve 29 which shifts slide 27 from one to the other of the bore 5 in housing 3. As shown, pilot valve 29 is mounted in close proximity to valve 1. For example, pilot valve may be mounted on a bracket 30 secured to fittings 15, 17 and 19. The pilot valve is connected to discharge port 7 and to opposite ends of valve body 3 by suitable capillary tubes. High pressure refrigerant is supplied to the pilot valve from discharge port 7. Upon energization of the solenoid operated pilot valve, it shifts application of pressure from one to the other of valve body 3 so as to effect axial movement of slide 27 within bore 5 between its stated first and second positions. Thus far described, reversing valve 1 is substantially conventional.

Referring now specifically to FIGS. 1–5, the construction and operation of slide member 27 of valve 1 of the present invention will now be set forth in detail. Slide 27 is shown to be a one piece casting of suitable metal (e.g., cast iron) or the like. In general, it is of elongate, cylindric shape having an outside diameter D (see FIG. 5) such that it is sealably, slidably received in bore 5 of body 3. As shown, slide 27 is substantially symmetrical about a central diametric plane. The slider has a blind, open mouth flow reversing cavity 31 at its center and a flow passage 33 or 35 at each end of the cavity. As shown, flow passages 33 and 35 are substantially identical, but opposite from one another, and they extend through the slider and are free of any obstruction to the flow of refrigerant therethrough. Thus, passages 33 and 35 in slider 37 have substantially identical flow characteristics therethrough.

Cavity 31 is defined in part by a pair of opposed inclined surfaces 37*a*, 37*b* in slider 27 which angle inwardly toward one another and toward the base or bottom 39 of the cavity. A pair of spaced surfaces 41*a*, 41*b* (see FIG. 5) extend parallel to the longitudinal axis of slider 27 and constitute the side walls of cavity 31 while the inclined surfaces 37*a*, 37*b* constitute the ends of the cavity. For reasons as will appear, inclined surfaces 37*a*, 37*b* are angled with respect to a diametric plane of slider 27, as indicated by angle A in FIG. 2. This angle may, for example, range between about 32° and 42°. As shown, angle A is about 37°. Cavity 31 preferably has a depth "d" from the top of inclined surfaces 37*a*, 37*b* to the bottom 39 of the cavity ranging between about 0.55D and 0.75D, where D is the outer diameter of the slide. As shown in FIG. 5, cavity 31 has a depth d of about 0.64D.

In FIGS. 1 and 2, slide 27 is further shown to have two additional inclined surfaces 43*a*, 43*b* which define the inner ends of flow passages 35 and 33, respectively. In general, each inclined inner end face 43*a* or 43*b* of passages 33 and 35 is parallel to and is in back-to-back relation with a corresponding inclined surface 37*a*, 37*b* of cavity 31 so that a wall of substantially uniform thickness is provided between each flow passage and cavity 31. As shown in FIG. 2, surfaces 43*a*, 43*b* are inclined with respect to a diametric plane of body 27 at an angle as indicated at B. For example, angle B may range between about 34° and 44°. As shown in FIG. 2, angle B is about 39°. The outer end of each flow passage 35, 33 is shown to be defined by a respective wall 45*a*, 45*b* which is generally perpendicular to the center axis of slide 27. It will be appreciated, however, that the angle of outer end walls 45*a*, 45*b* is not, at this time, thought to be critical to the operation of the valve of the present invention. Thus, within the broader aspects of this invention, these outer end walls may also be inclined with respect to the longitudinal axis of the slide. For example, the outer end walls 45*a*, 45*b* may be inclined so as to be generally parallel to its opposite inner end wall 43*a*, or 43*b* thereby to provide a passageway of generally uniform cross section between port 7 and its corresponding inlet/outlet 9 or 13.

A flat 47 may be provided on slide 27 opposite cavity 31. Also, a longitudinal slot 49 (see FIG. 4) is provided in slide 27 for receiving a key (not shown) provided in body 3 so as to hold the slide against rotation within bore 5 and to maintain cavity 31 and passages 33 and 35 in alignment with their respective ports in body 3. Still further, body 3 is provided with packing seals 51 (see FIG. 1) at each end thereof so as to seal the slide with respect to bore 5. It will be appreciated that bore 5 and the outer surface of slider 27 are preferably precision ground so as to have a slidable, sealable fit and that this substantially prevents leakage of refrigerant from one port to another inside body 3.

As shown in FIG. 1, discharge port 7 is located on one side of body 3 and ports 9, 11 and 13 are located opposite therefrom. Ports 9, 11 and 13 are substantially equally spaced from one another and are of approximately equal cross sectional areas (i.e., of equal diameter). Further, it will be noted in FIG. 1 that the open mouth of the cavity 3 is of sufficient length that when slide 27 is in either of its operative positions, center suction port 11 and one of the inlet/outlet ports 9 or 13 are fully in register with the mouth of the cavity and the other inlet/outlet port is fully in register with its respective flow passage 33 or 35.

In accordance with this invention, valve 1 with slide 27 installed therein has significantly less restriction to the flow of refrigerant through both cavity 31 and through passages 33 and 35 than comparable prior art reversing valves. While the reasons for the suprising flow characteristics of the valve of this invention (e.g., the reversing valve of this invention only has about one-half of the flow losses of comparably sized prior art reversing valves) are not fully understood, certain structural differences between valve member 27 of the present invention and the valve slides of the prior art valves are believed to at least in part contribute to the suprising gains in flow efficiencies of the valve of the present invention.

As has been heretofore noted, ends 37*a*, 37*b* of flow reversing cavity 31 are inclined. More specificially, these surfaces are inclined to such a degree that the direction of the flow of refrigerant discharged from one of the inlet/outlet ports 9 or 13 is smoothly turned 180° for discharge into center suction port 11 with mimimal loss of flow momentum and with little or no flow separation in the cavity. This significantly reduces the formation of eddy currents in the cavity and consequently reduces shock or turbulence losses in the fluid. As can be best seen in FIG. 1, refrigerant discharged from inlet/outlet port 9 impinges on inclined surface 37*a* and is deflected generally downwardly and inwardly (as viewed in FIG. 1) within cavity 31. The inclination of surfaces 37*a*, 37*b*, the length of base 39, and the depth d of cavity 31 are such that the fluid glances off a first inclined surface (i.e, it does not perpendicularly strike the inclined surface), base 39, and the opposite inclined surface so as to be smoothly directed toward outlet port 11. As is depicted by the relatively uniformly spaced streamlines in FIG. 1, the fluid flow in cavity 31 is substantially uniform in the cavity and the areas of the cavity in which separation may be expected to occur, viz, at the intersections of inclined surfaces 37*a*, 37*b* and base 39 and at the surface between the inlet/outlet port and suction port, are minimized so as to in turn mimimize flow losses through the valve. Of course, a similar but opposite flow pattern would be observed if the position of slide 27 were shifted in body 3 so that refrigerant discharged from inlet/outlet port 13 enters suction port 11.

With slide 27 in one of its operative positions, as shown in FIG. 1, discharge port 7 is in direct register with the mouth of a respective passage 33 or 35 for the discharge of high pressure refrigerant from the output side of compressor P directly into that passage. Inclined inner wall 43*b* of passage 33 is shown to be angled from the distal edge of discharge port 7 to the inner edge of inlet port 13 when the slide is in the position shown in FIG. 1. Thus, as refrigerant is discharged from port 7, it glances off (i.e., it does not impinge perpendicularly on) inclined wall 43*b* and is smoothly deflected toward port 13 with a minimum loss of momentum. Likewise, as the flow glances off outer end wall 45*b* of passage 33, it is smoothly deflected into port 13 with a minimum loss of momentum. The relatively smooth flow from discharge port 7 to a corresponding inlet/outlet port 9 or 13 is depicted by the generally parallel streamlines shown in FIG. 1. As heretofore noted, passages 33 and 35 are free of obstructions to the flow of fluid therethrough and have nearly identical flow characteristics.

PRIOR ART

Referring now to FIG. 9, a typical prior art reversing valve, as indicated in its entirety at 101, is illustrated. As heretofore noted, the more basic features of the reversing valve 1 of the present invention are similar to known four way reversing valves and thus the "primed" reference characters in FIG. 9 indicate corresponding parts of the prior art reversing valve having a similar construction or function to the already described corresponding parts of valve 1. Like valve 1, prior art reversing valve 101 has a slide 103 movable within bore 5' for shifting the flow of refrigerant between the various ports of the valve generally in the same manner as valve 1. As shown, slide 103 is an elongate, generally cylindric member which is sealably, slidably received in bore 5' of housing 3'. Slide 103 has a flow reversing cavity or "bathtub" 105 therein for receiving refrigerant from one of the inlet/outlet ports 9' or 13' and for directing it into suction port 11'. However, it will be particularly noted that the surfaces 107*a*, 107*b* forming the ends of cavity 105 are generally perpendicular to both the longitudinal axis of slide 103 (i.e., they are not inclined) and to the surface 109 forming the bottom or base of the cavity. While a radiused transition has been utilized between end walls 107*a* and 107*b* and base 109 so as to provide a more smooth transition, the refrigerant nevertheless impinged primarily perpendicularly on base 109 with a resultant high loss of momentum. Also, after the refrigerant had impinged on base 109 and had began to move parallel thereto, it was then again forced to perpendicularly impinge on the opposite end wall 107*a* or 107*b* with a consequent relatively high loss of momentum. Also, due to the abrupt changes in fluid flow direction, significant eddy currents or flow separations resulted as the refrigerant flows through cavity 105 thus further increasing flow losses.

As indicated at 111 and 113, prior art slide 103 has a respective circumferential groove at each end thereof with a respective center portion 115, 117 extending through each groove. A longitudinal channel 119 is provided on the face of slide 103 opposite from cavity 105 for providing communication between discharge port 7 and grooves 111 and 113. As shown in FIG. 9, with the slide in one of its operative positions, one of the circumferential grooves 111 or 113 is in register with an inlet/outlet port 9' or 13' so that a portion of channel 119 and a groove 111 or 113 together form a flow passage between discharge port 7' and a selected inlet/outlet port 9' or 13'. However, it will be observed that refrigerant discharged from port 7' perpendicularly impinges on the base of channel 119 from whence it enters a selected groove 111 or 113. Then, it must flow around center portion 115 or 117 as it flows toward its intended inlet/outlet port.

EXAMPLE

Tests have been conducted to compare the flow losses through a four way reversing valve 1 of the present invention, such as is shown in FIG. 1, and a prior art reversing valve, such as is shown in FIG. 9. The valves were approximately of the same overall physical size and had the same size ports. The valves were connected in a refrigerant flow test setup so that R-22 refrigerant (i.e., monochlorofluoromethane) was caused to flow through the valves in the manner heretofore described. Based on a condenser temperature of 100° F. (38° C.), an evaporator temperature of 40° F. (4.4° C.), and a pressure drop of 2.0 psig through the valves, the discharge capacity of the prior art reversing valve was found to be 2.0 tons (5.8 lbs./min.) of refrigerant. Surprisingly, the discharge capacity of reversing valve 1 of the present invention was found to be 6.8 tons (17.7 lbs./min.) of refrigerant with 2.0 psig pressure drop thereacross. Thus, a reversing valve of the present invention has about 3.4 times the discharge capacity of a comparably sized prior art reversing valve with a similar 2.0 psig pressure drop across the valves. Likewise, the suction capacity of the prior art and present reversing valves were respectively determined to be 3.8 and 6.0 tons (9.88 and 15.6 lbs./min.) of refrigerant. Thus, the suction capacity of a valve of the present invention is about 1.58 times the suction capacity of a similarly sized prior art reversing valve with a similar 2.0 psig pressure drop thereacross.

Hence is has been found that a reversing valve 1 of the present invention may be of substantially smaller size than prior art reversing valves and yet is capable of handling comparable flow rates of refrigerant with a similar pressure drop thereacross. Of course, because reversing valves of the present invention are able to be of smaller size, they are substantially less costly to manufacture.

Referring now to FIG. 6, a modification of valve 1 of the present invention is illustrated. This second embodiment, as indicated in its entirety at 1A, corresponds generally to valve 1 heretofore described and corresponding reference characters indicate parts having corresponding constructions and functions. In essence, the primary difference between valves 1 and 1A, is that in valve 1, discharge port 7 is aligned with the center suction port 11, while in valve 1A discharge port 7A is offset relative to the center suction port and is more generally in line with inlet/outlet port 13 so as to provide a more direct flow passage from discharge port 7A to inlet/outlet port 13 when valve 1A is in one of its operating positions, such as illustrated in FIG. 6. When the valve 1A is in its other operating position (i.e., with its slide 27' shifted from the position shown in FIG. 6) refrigerant discharged from port 7A impinges on flat 47 and flows between flat 47 and body 3 to passage 35 for entrance into the other inlet/outlet port 9. Of course, valve 1A will exhibit a significantly higher flow capacity when it is in one of its operating positions with its discharge port 7A in straight through alignment with its inlet/outlet port 13 such as may, for example, be desired for greater cooling demand.

In view of the above, it will be seen that the several objects of this invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

I claim:

1. In a reversing valve for a heat pump system or the like, said heat pump system including a first coil, a second coil, said first and second coils being operatively connected to one another, and a compressor having a suction inlet for drawing low pressure refrigerant from one of said coils, and a discharge outlet for supplying refrigerant at high pressure to the other of said coils, said reversing valve being adapted to be connected in said heat pump system and being selectively operable in either a first position for supplying high pressure refrigerant to said first coil and for receiving low pressure refrigerant from said second coil or a second operative position for supplying high pressure refrigerant to said second coil and for receiving low pressure refrigerant from said first coil, said valve having a body with a bore therein, said body having a plurality of ports therethrough in communication with said bore including a high pressure inlet port adapted to be connected to the discharge outlet of said compressor, a low pressure outlet port adapted to be connected to the suction inlet of said compressor, a first inlet/outlet port adapted to be connected to said first coil, and a second inlet/outlet port adapted to be connected to said second coil, said valve further including a slide sealably, slidably movable in said bore between a first position in which said reversing valve is in its first operative positon and a second position in which said reversing valve is in its second operative position, said slide having a flow switching cavity therein in communication with said low pressure outlet port and with said second inlet/outlet port when said slide is in its first position and in communication with said low pressure outlet port and with said first inlet/outlet port when said slide is in its second position for receiving low pressure refrigerant from one of said coils and for directing it to the suction side of the compressor, wherein the improvement comprises: said slide having a one-piece slide body with said flow switching cavity therein, said one-piece slide body further having a first flow passage on one side of said cavity extending straight through said slide body without obstruction therein for communication between said high pressure inlet port and said first inlet/outlet port when said slide is in one of its stated positions and a second flow passage in said slide body on the side of said cavity extending straight through said slide without obstruction therein for communication between said high pressure inlet port and said second inlet/outlet port when said slide is in its other position, said slide having a pair of inclined walls angling inwardly toward one another and toward the cavity bottom with the outer ends of the inclined surfaces defining a cavity mouth of such size that said low pressure outlet port and one of said inlet/outlet ports are in register with said cavity when the slide member is in either its first or second position, with the inner faces of said inclined walls forming the ends of said cavity, and with the outer faces of said inclined walls forming the inner ends of said flow passages, so that fluid flowing through the cavity is smoothly deflected by said inner faces of said inclined walls so as to enter the low pressure outlet port with a minimum loss of momentum or flow energy and so that the fluid discharged from said high pressure outlet port is diverted by said outer faces of said inclined walls to a selected inlet/outlet port with a minimum loss of flow energy.

2. In a reversing valve as set forth in claim 1 wherein said slide body has surfaces forming the side walls of said cavity, said side walls being spaced apart a distance approximately equal to or greater than the width of said inlet/outlet ports.

3. In a reversing valve as set forth in claim 1 wherein said inclined walls are angled with respect to the direction of fluid flow discharged from said inlet/outlet ports such that the fluid discharged therefrom is smoothly deflected toward the bottom of said cavity and toward the opposite inner face of said inclined wall so that the fluid is smoothly and uniformly deflected toward said low pressure outlet port substantially without fluid separation within said cavity.

4. In a reversing valve as set forth in claim 1 wherein said inner surfaces of said inclined walls are inclined from a diametric plane of said slide body at an angle ranging between about 32°–42°.

5. In a reversing valve as set forth in claim 4 wherein said angle is preferably about 37°.

6. In a reversing valve as set forth in claim 1 wherein said inner and outer faces of each of said inclined walls are substantially parallel to one another.

7. In a reversing valve as set forth in claim 6 wherein said inner faces of said inclined walls are inclined with respect to a diametric plane of said slide at an angle ranging between about 35°–39° and said corresponding outer faces of said inclined walls are incliend with respect to a diametric plane of said slide at an angle ranging between about 37°–41°.

8. In a reversing valve as set forth in claim 1 wherein said first inlet/outlet port, said low pressure outlet port, and said second inlet/outlet port are disposed on one side of said body along a line extending generally axially of the body and are substantially of equal cross section area and are substantially equally spaced from one another, and wherein said discharge port is located opposite thereof.

9. In a reversing valve as set forth in claim 8 wherein said discharge port is substantially in line with said low pressure outlet port.

10. In a reversing valve for a heat pump system or the like, said heat pump system including a first coil, a second coil, said first and second coils being operatively connected to one another, and a compressor having a suction inlet for drawing low pressure refrigerant from one of said coils, and a discharge outlet for supplying refrigerant at high pressure to the other of said coils, said reversing valve being adapted to be connected in said heat pump system and being selectively operable in either a first position for supplying high pressure refrigerant to said first coil and for receiving low pressure refrigerant from said second coil or a second operative position for supplying high pressure refrigerant to said second coil and for receiving low pressure refrigerant from said first coil, said valve having a body with a bore therein, said body having a plurality of ports therethrough in communication with said bore including a high pressure inlet port adapted to be connected to the discharge outlet of said compressor, a low pressure outlet port adapted to be connected to the suction inlet of said compressor, a first inlet/outlet port adapted to be connected to said first coil, and a second inlet/outlet port adapted to be connected to said second coil, said valve further including a slide sealably, slidably movable in said bore between a first position in which said reversing valve is in its first operative position and a second position in which said reversing valve is in its second operative position, said slide having a flow switching cavity therein in communication with said low pressure outlet port and with said second inlet/outlet port when said slide is in its first position and in communication with said low pressure outlet port and with said first inlet/outlet port when said slide is in its second position for receiving low pressure refrigerant form one of said coils and for directing it to the suction side of the compressor, wherein the improvement comprises: said slide having a one-piece slide body with said flow switching cavity therein, said one-piece slide body further having a first flow passage on one side of said cavity extending straight through said slide body without obstruction therein for communication between said high pressure inlet port and said first inlet/outlet port when said slide is in one of its stated positions and a second flow passage in said slide body on the side of said cavity extending straight through said slide for communication between said high pressure inlet port and said second inlet/outlet port when said slide is in its other position, said slide having a pair of inclined walls angling inwardly toward one another and toward the cavity bottom with the outer ends of the inclined surfaces defining a cavity mouth of such size that said low pressure outlet port and one of said inlet/outlet ports are in register with said cavity when the slide member is in either its first or second position, with the inner faces of said inclined walls forming the ends of said cavity, and with the outer faces of said inclined walls forming the inner ends of said flow passages, so that fluid flowing through the cavity is smoothly deflected by said inner faces of said inclined walls so as to enter the low pressure outlet port with a minimum loss of momentum of flow energy and the fluid discharged from said high pressure outlet port is diverted by said outer faces of said inclined walls to a selected inlet/outlet port with a minimum loss of flow energy, wherein said first inlet/-outlet port, said low pressure outlet port, and said second inlet/outlet port are disposed on one side of said body along a line extending generally axially of the body and are substantially of equal cross section area and are substantially equally spaced from one another, and wherein said discharge port is located opposite thereof, and wherein said discharge port is substantially in line with one of said inlet/outlet ports so that with said slide body in one of its positions a respective flow passage therein is in register with said discharge port and with said one inlet/outlet ports, so that high pressure refrigerant from said compressor flows substantially straight through said passage substantially without change of direction from said discharge port to said one inlet/outlet port.

11. In a reversing valve as set forth in claim 10 further comprising a flow channel in said slide member for providing communication between said discharge port and said other flow passage when said slide member is in its other position.

12. In a reversing valve for a heat pump or the like having a body with a bore therein, said body having a discharge port adapted to be connected to the discharge side of a heat pump compressor, and, on the opposite side of said body from said discharge port, a first inlet/-outlet port adapted to be connected to a first evaporator/condenser coil, a second inlet/outlet port adapted to be connected to a second evaporator/condenser coil, and a suction port between said first and second inlet/-outlet ports and being adapted to be connected to the suction side of said compressor, said valve further having a slide member movable axially within said bore of said body between a first and second position, wherein the improvement comprises: a flow direction reversing cavity within said slide member for receiving fluid from one of said inlet/outlet ports and for directing it into said suction port, a pair of flow passages extending through said slide, one at each end of said cavity, said passages providing communication through said slide from said discharge pump to said inlet/outlet ports, said passages being free of obstruction to the flow of fluid therethrough said slide member having a pair of inclined common walls angling toward one another with the inner surfaces of said walls constituting the ends of said cavity and with the outer surfaces of said walls consituting the inner ends of said passages the outer ends of the inner surfaces of said inclined walls being spaced apart a distance substantially equal to the distance between opposite distal portions of one of said inlet/outlet ports and said suction port so that with said slide member in either its first or second position one of said inlet/outlet ports and said suction port are in register with said cavity, said outer surfaces of said inclined walls being so disposed such that with the slide member in one of its stated positions fluid discharged from said discharge port impinges on a respective inclined outer surface of said said walls and is smoothly directed through a respective flow passage toward a respective inlet/outlet port in register with this last-said flow passage.

13. In a reversing valve as set forth in claim 12 wherein the inclined outer surfaces of each of said common inclined walls, is each generally parallel to an adjacent corresponding inclined inner surface of said wall.

* * * * *

UNITED STATES PATENT AND TRADEMARK OFFICE

CERTIFICATE OF CORRECTION

PATENT NO. : 4,255,939

DATED : March 17, 1981

INVENTOR(S) : Sam A. Ou

It is certified that error appears in the above—identified patent and that said Letters Patent is hereby corrected as shown below:

Column 4, line 18, "het" should be "heat".

Column 6, line 10, "specificially" should be "specifically".

Column 10, line 8, "incliend" should be "inclined".

Signed and Sealed this

*Twenty-ninth* Day of *September 1981*

[SEAL]

*Attest:*

GERALD J. MOSSINGHOFF

*Attesting Officer*

*Commissioner of Patents and Trademarks*